US006305455B1

(12) United States Patent
Wendel

(10) Patent No.: US 6,305,455 B1
(45) Date of Patent: Oct. 23, 2001

(54) MULTIPLE PANEL DISPLAY SYSTEM

(76) Inventor: Christopher M. Wendel, 646 Maye St., Westfield, NJ (US) 07090

( * ) Notice: Subject to any disclaimer, the term of this patent is extended or adjusted under 35 U.S.C. 154(b) by 0 days.

(21) Appl. No.: 09/680,170

(22) Filed: Oct. 5, 2000

Related U.S. Application Data

(60) Provisional application No. 60/157,555, filed on Oct. 4, 1999.

(51) Int. Cl.[7] ..... A47G 5/00

(52) U.S. Cl. ..... 160/135; 160/231.1

(58) Field of Search ..... 160/135, 352, 160/231.1, 231.2, 351, 391, 392, 395; 52/238.1, 239; 40/605, 606, 610

(56) References Cited

U.S. PATENT DOCUMENTS 3,562,973 * 2/1971 Gangemi ..... 160/135
3,592,289 * 7/1971 Aysta et al. ..... 160/135 X
4,232,724 * 11/1980 Brown ..... 160/135
4,344,475 * 8/1982 Frey ..... 160/135
4,977,696 * 12/1990 Johansson ..... 160/135 X
5,339,576 * 8/1994 Fussler ..... 160/135 X
5,502,930 * 4/1996 Burkette et al. ..... 160/135 X

* cited by examiner

*Primary Examiner*—David M. Purol

(57) ABSTRACT

A multiple panel display system wherein horizontally adjacent panels are hingedly attached by the adhesive mounting of elongated flexible interlocks. The interlocks can be uncoupled to disassemble the display system. In addition, the panels contain receiving sockets in the ends to permit the use of pins for vertical stacking of panels. The flexible interlocks mounted on the surface of the panels permits the display to assume a variety of shapes.

7 Claims, 2 Drawing Sheets

MULTIPLE PANEL DISPLAY SYSTEM

CROSS REFERENCE TO RELATED APPLICATION

The present application is based on provisional patent application Serial No. 60/157,555, filed on Oct. 4, 1999.

BACKGROUND OF THE INVENTION

This invention relates to a modular display having multiple panels hingedly attached one to another to enable the shape of the display to be varied as desired.

In the field of providing equipped and defined space for exhibition and meetings, the complexity of the equipment used for display and to define the boundaries of allocated space is quite important in that it primarily determines the time required for assembly and the skills needed by the workforce. Since the labor costs are a significant factor in the cost of constructing and deconstructing the display equipment, the suppliers of this type of equipment are continually seeking to develop simplified modular equipment capable of rapid set-up and take down with an unskilled labor force.

The present invention provides a modular display system formed from multiple panels that can be rapidly joined through the use of flexible surface-mounted interlocks located between adjacent panels. The panels are identical and are preferably provided with receiving sockets to allow vertical stacking in addition to their use as a horizontal display. The flexible interlock enables the assembler to create the desired shape or contour for the display area when used as a boundary installation or as a display wall. The flexible interlocks are surface mounted which enables adjacent panels to be folded back on one another thereby providing essentially 180 degree rotation therebetween. The wide range of rotation enables the panels to be jointed together to form a closed structure if desired.

SUMMARY OF THE INVENTION

The invention concerns the provision of a multiple large area panel display system in which adjacent panels are hingedly attached one to another in a manner which permits facile connection and separation. The longitudinal edges of the panels are provided with a strip of flexible material that is secured by an adhesive interposed between panel surface and flexible strip.

The flexible strip is comprised of a planar bonding area for affixation to the panel and an offset tab having two receiving sockets. The offset tab is connected to the planar bonding area by an intermediate hinge section. The hinge section is substantially or thogonal to the planar bonding area and the offset tab.

The receiving sockets in the offset tab are broader in their base than at the neck so as to form non-uniform projections therebetween. The projections have approximately the same shape in cross-section as the sockets. Thus, the flexible strips as secured to adjacent panels are reversed to provide a flexible inter connection therebetween.

The adjacent strips are secured to adjacent panel edges thereby enabling the panels to be rotated and aligned to form display walls of a variety of shapes.

The display panels comprise two large area members secured by spacers extending longitudinally. The flexible interlocking strips are secured along longitudinal edges. The lateral edges of joined panels can be stacked one upon the other by the use of spherical couplers having diametrically opposed pins between the spacers of vertically adjacent panels. The flexible interlock strips and the spherical couplers enable the assembler to quickly erect a multiple panel display wall to a wide variety of specifications.

Further features and advantages of the invention will become more readily apparent from the following detailed description of a preferred embodiment when taken in conjunction with the accompanying drawings.

DESCRIPTION OF THE PREFERRED EMBODIMENT

Figure 1:
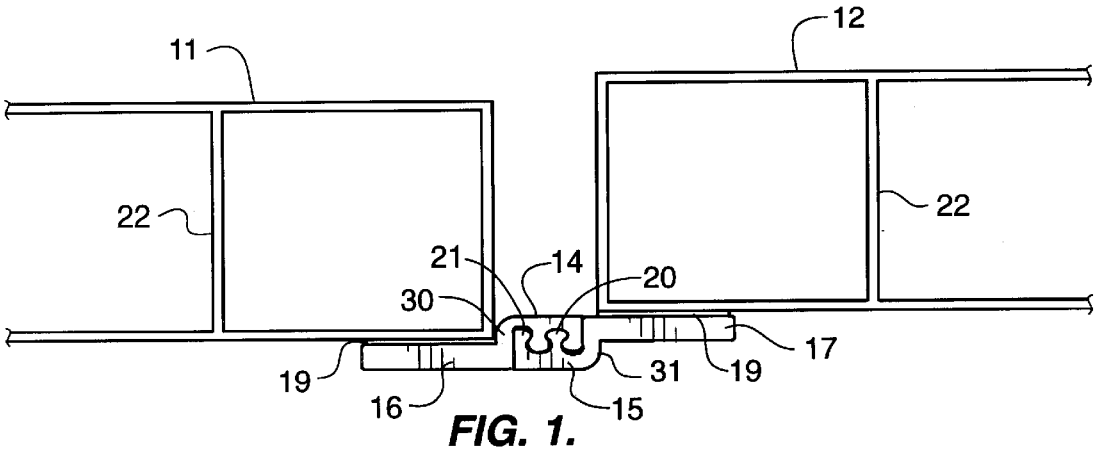
FIG. 1 is a top view of adjacent panels interlocked in accordance with the present invention.
Figure 2:
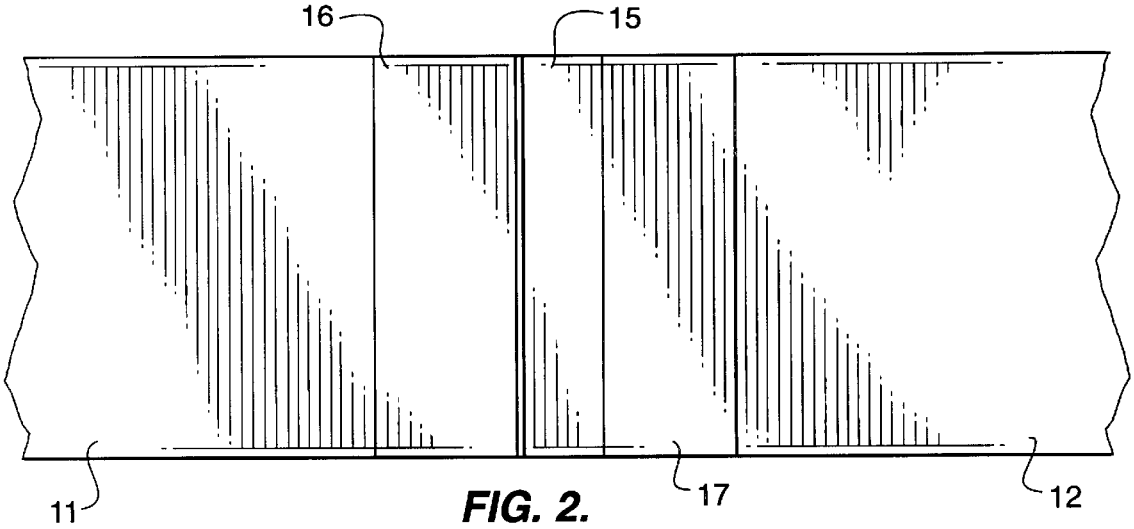
FIG. 2 is a front view of the panels of FIG. 1.
Figure 3:
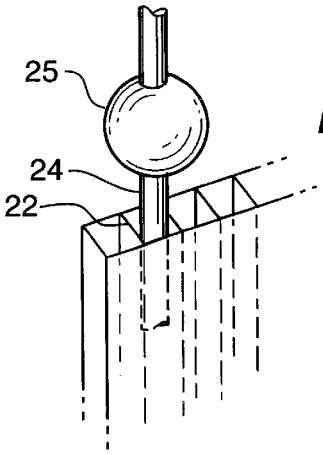
FIG. 3 is a spherical coupler used for vertical placement of the panels.

The drawings illustrate a preferred embodiment of the invention in FIGS. 1 through 4. The top edge view in FIG. I and the corresponding front view of FIG. 2 show adjacent panels 11 and 12 coupled together by flexible interlock comprised of planar bonding areas 16, 17, the offset tabs 14, 15 and intermediate hinge sections 30, 31. The interlock is formed by the releasable coupling of planar bonding areas 16 and 17 which are secured to the large area surfaces of the panels. The strips are identical in cross-section but reversed in relation to one another when applied to the panels. As shown, the strips are affixed by adhesive layers 19 which can be formed from an applied liquid adhesive or by using a double-sided adhesive tape.

The hinge mechanism of the flexible interlock is provided by spaced projections 20, 21 being received in the channels formed between like projections of the adjacent end strip. The projections 20, 21 each have an expanded head which both defines the channel and enables the adjacent strips to remain interlocked during bending of the hinge sections 30, 31. The protrusions 20, 21 can be directly placed in the channels by the application of mechanical force or may be aligned for sliding engagement therebetween. The projection 21 at the end of the offset tab is terminated in a right angle to aid in having the bending confined to hinge sections 30,31.

Figure 4:
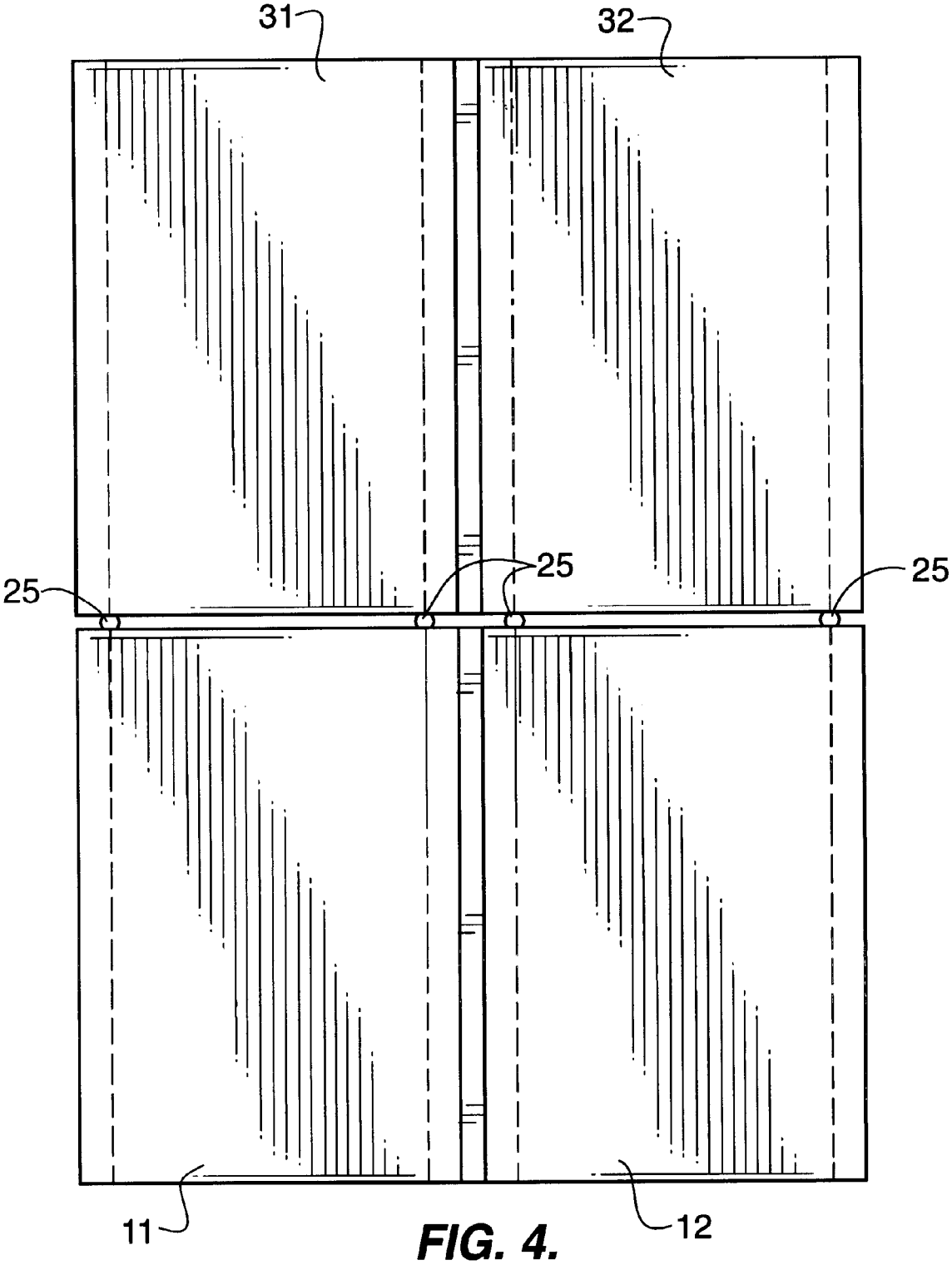
FIG. 4 is a front view showing four panels interlocked and coupled in accordance with the invention.

The panels may be rigid or flexible and are preferably formed from a polycarbonate material with spaced intermediate support members 22 orthogonally disposed between the opposing surfaces of each panel. In an application wherein panels are to be stacked, the spacing of the support members 22 establishes receiving sockets for aligning pins 24, one of which is shown in place in FIG. 3. The alignment pin 24 extends diametrically through the enlarged section at its midpoint, shown as a sphere 25, which both maintains the pin in place and provides load bearing surfaces for the panels 31 and 32 as shown in FIG. 4.

The flexible hinge is shown in the figures as mounted on the adjacent large area surfaces of the panels. Thus, the panels can be folded through the full range in one direction without the end walls of one panel contacting the adjacent panel. As a result, the modular display system is sufficiently versatile to allow three panels to form an isosceles triangle. By using reduced height panels, a functional workplace can be established by providing a top to the closed assembly.

The use of the present invention enables the desired shape walls and displays to quickly be assembled without requiring tooling or a skilled work force. A cap for each panel can be provided for a more finished look. In addition, the wiring for lighting can be threaded through vertical channels in the panels. It is to be noted that modifications may be made to the present invention without departing from the scope thereof.

What is claimed is:

1. A modular display system having multiple detachable panels comprising:

a) a plurality of panels, each panel having opposing large area surfaces spaced by end walls and bounded by lateral edges and longitudinal edges;

b) first and second flexible interlock strips affixed to a large area surface of the corresponding panel and extending outwardly of a longitudinal edge, each strip having a protrusion and a receiving socket along the edge thereof for engagement with like protrusion and socket in the adjacent strip, each strip releasably engaging an adjacent strip to form a hinge located between the longitudinal edges of adjacent panels; and c) an adhesive layer interposed between a flexible interlock strip and large area surface for securing said strip to said surface.

2. The modular display system of claim 1 wherein said first and second flexible interlock strips each comprise a planar bonding area for affixation to a panel, an offset tab having a protrusion and a receiving socket and a hinge section therebetween.

3. The modular display system of claim 2 wherein each said offset tab includes two protrusions and two receiving sockets.

4. The modular display system of claim 3 wherein said first and second interlock strips are identical in cross-section.

5. The modular display system of claim 4 wherein a protrusion in the offset tab is terminated at a right angle.

6. The modular system of claim 5 wherein each panel contains a plurality of receiving sockets located in an end wall adjacent to a lateral edge, and further comprising pin members for placement in the receiving sockets, said pin members enabling the stacking of multiple panels.

7. The modular display system of claim 6 wherein said pin members include a central spherical section.

* * * * *